US005146701A

United States Patent [19]

Lee

[11] Patent Number: 5,146,701

[45] Date of Patent: Sep. 15, 1992

[54] LIQUID SWING DECORATION

[76] Inventor: Vincent K. W. Lee, No. 44, Lane 458, Sheh Chung Street, Taipei, Taiwan, Taiwan

[21] Appl. No.: 458,943

[22] Filed: Dec. 29, 1989

[51] Int. Cl.[5] ..... H01F 1/00

[52] U.S. Cl. ..... 40/406; 428/13; 428/900; 446/133; 446/267; 446/396

[58] Field of Search ..... 446/325, 326, 133, 134, 446/396, 267; 40/406–426; 428/7, 13, 900

[56] References Cited

U.S. PATENT DOCUMENTS

| | | | |
|---|---|---|---|
| 3,613,264 | 10/1971 | Vitka et al. | 40/406 X |
| 4,176,469 | 12/1979 | Timco | 40/406 X |
| 4,432,158 | 2/1984 | Nicholas | 446/325 |
| 4,753,623 | 6/1988 | Krut | 446/133 |

FOREIGN PATENT DOCUMENTS

| | | | |
|---|---|---|---|
| 416460 | 11/1946 | Italy | 446/326 |

*Primary Examiner*—Henry F. Epstein
*Attorney, Agent, or Firm*—Ladas & Parry

[57] ABSTRACT

The invention is a liquid swing decoration having a partially liquid filled hollow bar which pivots at a central portion on a base stand. Magnets are attached at both ends of the bar and magnets are also located in the base stand. The base stand magnets are connected to supporting racks at one end while cam rods are connected to the other end of the supporting rods. Springs dampen the movement of the supporting rods. The effects of the magnets allows the liquid filled hollow bar to wag for long periods of time after it has been set in motion, so that the liquid inside the hollow bar can either shake vigorously or mildly to produce a gentle wave-like motion for decoration and visual pleasure.

4 Claims, 6 Drawing Sheets

LIQUID SWING DECORATION

BACKGROUND OF THE INVENTION

1. Field of the Invention

Recently, due to the rise in living standards and material possessions, people have become much more interested in all sorts of swing decorations. Especially the recently invented liquid dripper has been beloved by a lot of consumers. As the liquid dripper is a kind of swing decoration, designs for this object focus on its uniqueness and novelty. Under this concept, the inventor has designed a liquid swing decoration which is unique and novel in structure.

2. Brief Description of the Prior Art

There is a kind of decoration which is similar to this invention, but it needs electricity to supply energy for its mechanism to produce the same function (it might be seen in the window of an optical company). If the electricity is cut off, the body is stuck; its function is ineffective and cannot be manually operated. Of course, the fun of an ordinary table liquid decoration, such as liquid drippers, cannot be obtained, since the decoration must be inverted after the liquid drips completely to one end, then the same action must be repeated. But the mechanism of a liquid dripper is too simple to produce various views which is one of its disadvantages. There is another kind of metal product which can move repeatedly by applying external force. There are two metal balls at each side of a balanced rod. When it is pushed, it shakes for a certain period of time. It also lacks changes.

SUMMARY OF THE INVENTION

The structure of the invention is a long hollow bar with liquid contained inside. A pivotable support shaft pivots on a stand under the central part of the long hollow bar, so that the bar can swing freely on it. Magnets are put at both ends of the bar, and opposing repulsive magnets are put in the stand at relative positions. The lever principle is applied to produce relative motions between each magnet in the stand and a cam rod associated therewith. There is a spring on the cam rod to damp its up and down velocity. To use the invention, we can apply external force on one end of the bar then release it. When such force is applied, the cam rod will push down the lever to move the stand magnet up at the other end of the lever, and the relative opposing magnets in the stand and on the bar, become repulsive because they are close to each other. The spring is tensioned to store energy. When external force is released, the bar is forced up by the compressed spring and the repulsive magnetic force can control the bar in order not to impulse with the base stand, and violent vibrations can be reduced. The end of the bar that was initially moved down by applying external force raises while the other end lowers to result in a repeated motion. Thus, the bar can wag to the left or right and up or down repeatedly and the motion lasts much longer than one would expect and will not stop quickly. The liquid in the bar is designed to form wave motion. When bar wags, the wave can move from side to side to form a magnificent view (this view function is not the claim of this invention, the purpose is to show its usage). This liquid decoration can produce longer motion repeatedly after the application of external force without the supply of electricity. Because it does not come to equilibrium easily, small external force such as a mild wind can activate it to increase its appreciation value at all times.

DETAILED DESCRIPTION OF THE PREFERRED EMBODIMENT

Figure 1:
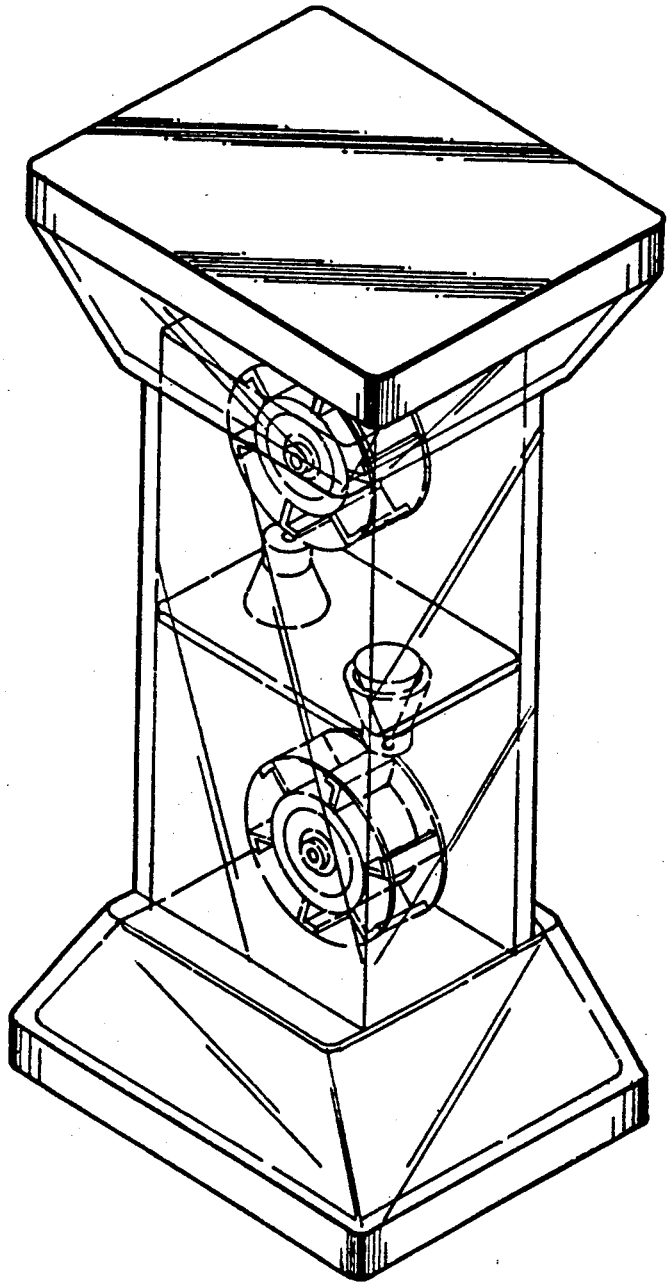
FIG. 1: perspective drawing of a conventional liquid decoration.
Figure 2:
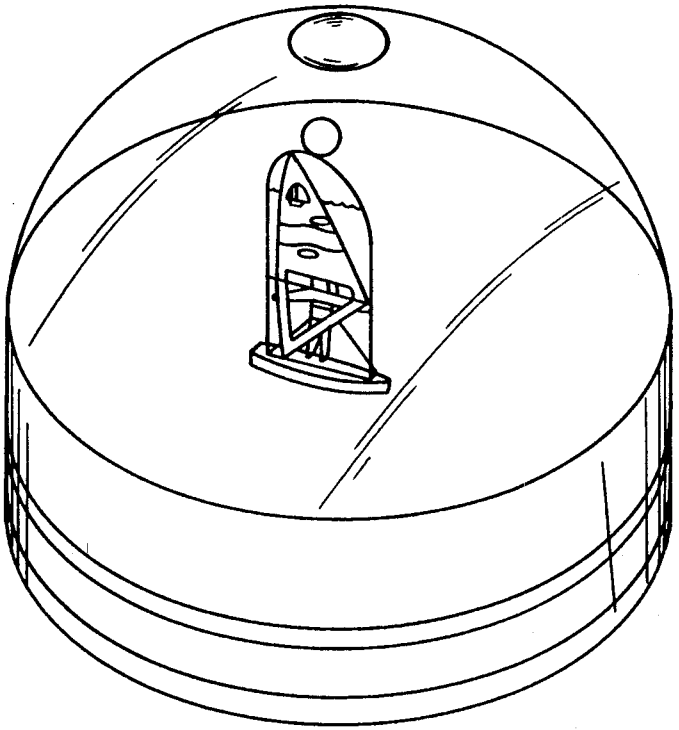
FIG. 2: perspective drawing of another conventional liquid decoration.
Figure 3:
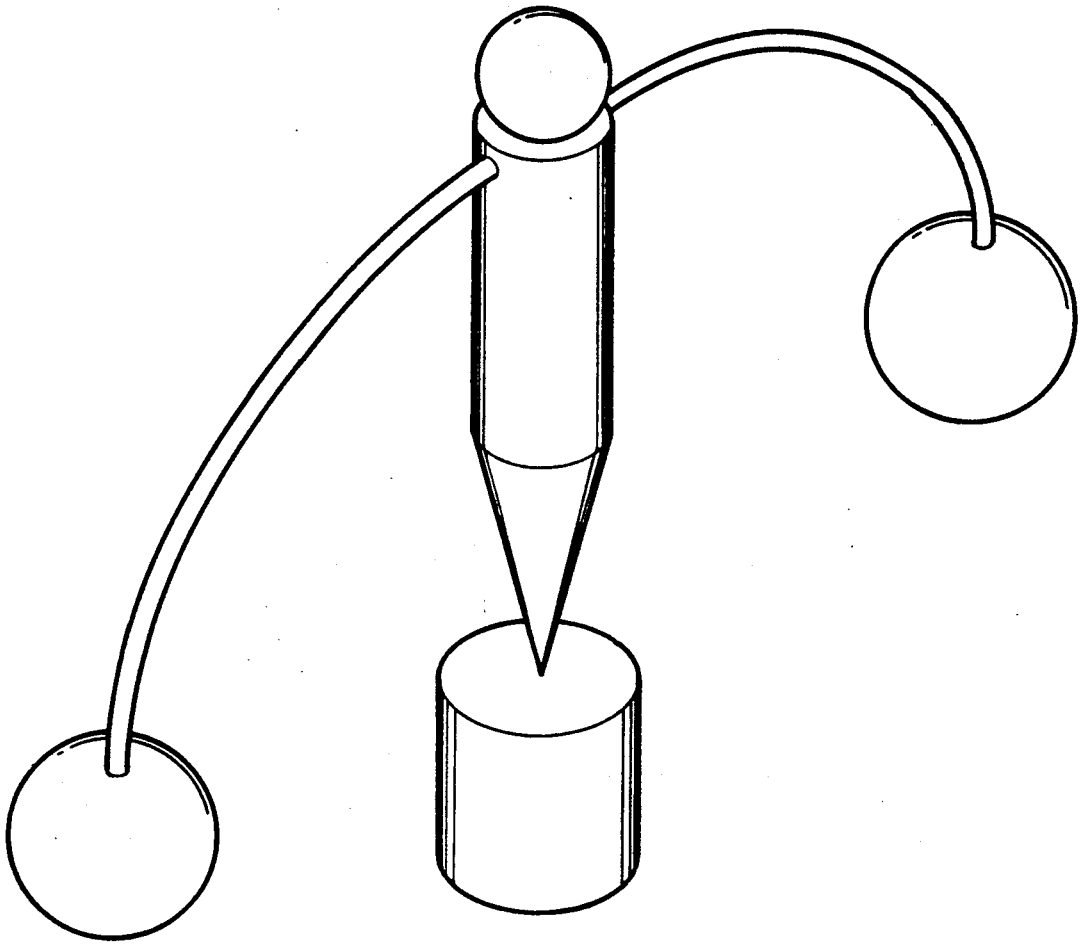
FIG. 3: perspective drawing of a conventional solid swing device.

FIG. 1 shows a kind of prior art dripper decoration. After the liquid inside drips from one end, we can reverse it to start another dripping. There are many products of this kind in the market. FIG. 2 shows a paper weight type decoration. Small objects such as sails on top of the liquid inside can float as it is shaked. But if no external force is applied, it will stay motionless like stagnant water. FIG. 3 shows an ever-up-right-doll type decoration by special design using gravitational force principles. It can wag for a long time after external force is applied. However, as it is a fixed object, there is little variation.

The present invention is an innovational design to compensate for the aforementioned disadvantages, and there are two special features:

1) If no external force is applied, the liquid level stays still; mild waves can be produced to provide the image of a calm sea with a little bit of force.

2) If external force is applied, it wags from side to side for a longer time with a heavy wave motion, and gradually the wave recovers to mildness in rich variation, and its values for decoration and entertainment are relatively raised.

Figure 4:
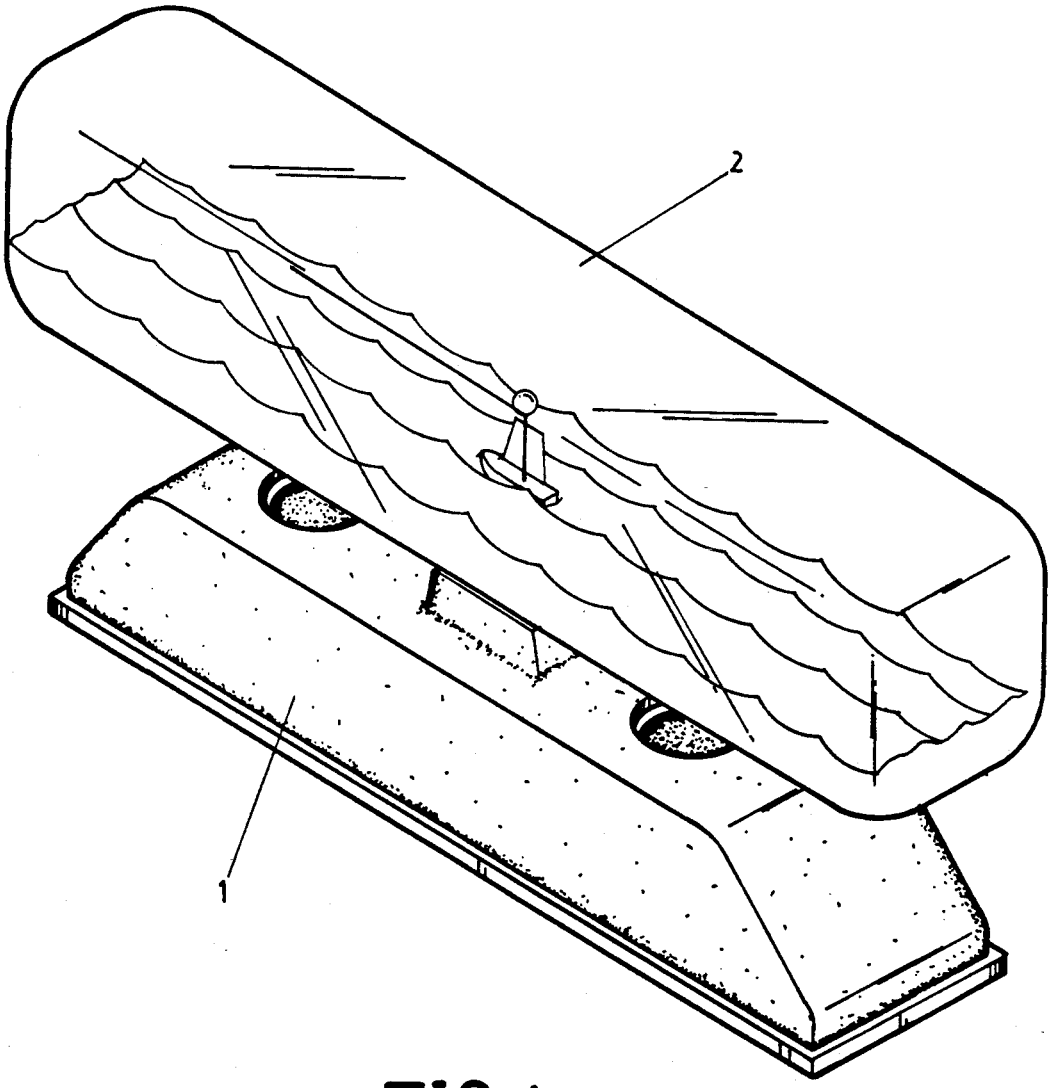
FIG. 4: perspective drawing of the invention.
Figure 5:
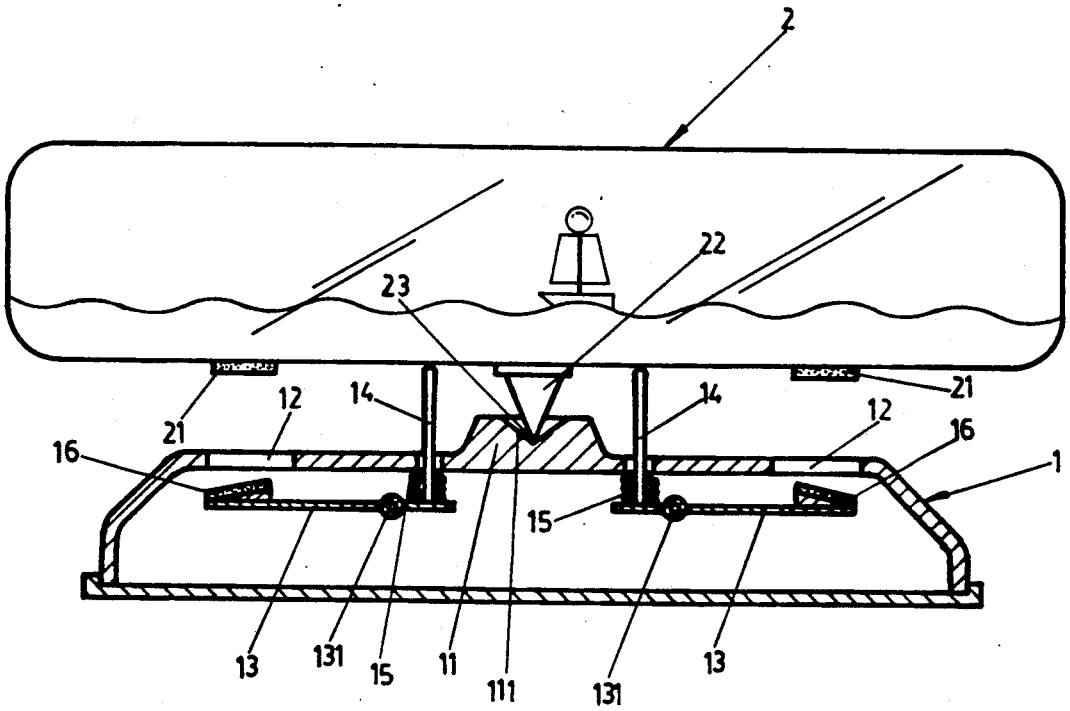
FIG. 5: side view of the invention in its normal condition.
Figure 6:
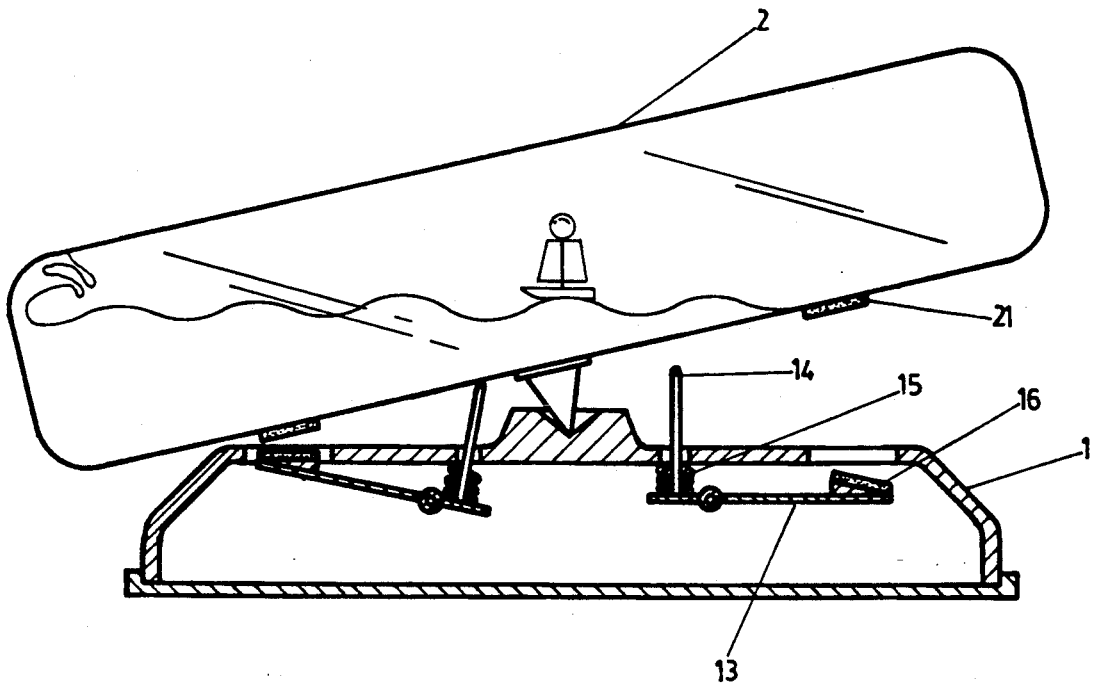
FIG. 6: side view of the invention in its activated condition.

With reference to FIGS. 4–6, the invention includes two major parts: a base stand 1 and a long bar 2. The long bar 2 is hollow and transparent with liquid inside it. It can be designed for wave motion and floating objects (since this is a conventional technique for liquid design, it will not be described here). There are magnets 21 at both ends of the long bar 2. An inverse triangular supporting shaft 22 is equipped at the central part of it. Its triangular sharp line 23 is used as a support in cooperation with the base stand 1. The base stand 1 is a shell whose length is about the same length as that of the long bar 2 and is designed to be put on a table. There is a shaft rack body 11 at the center of the base stand 1. The shaft rack body 11 can be connected to the base stand 1 to set a groove 111 for the installation of the triangular sharp line 23 of the supporting shaft 22 so that the long bar 2 can wag left and right freely from side to side on the base stand 1 to prevent it from dropping off. There are apertures 12 on the stand 1 corresponding to positions between the magnets 21 on both ends of the base stand 1 and the long bar.

There is also provided a set of connected units containing a supporting lever 13. A shaft 131 on the supporting lever 13 is used as the fixed supporting point for the pivoting motion of the lever 13. When supporting lever 13 is in a horizontal position, cam rod 14 projects out above the top of the base stand 1 to hold the bottom of long bar 2 when it is in a horizontal position. When one end of long bar 2 is pushed down, cam rod 14 is depressed and spring 15 is stretched. At the same time, magnet 16 at the other end of the supporting lever 13 is raised above the aperture 12. The magnets 16 and 21 are positioned to be in a mutually repelling orientation. The lowest point which the long bar 2 can reach is designed for magnet 21 to pass into the aperture 12. When the cam rod 14 is depressed, the magnet 16 is moved to be raised above the aperture 12. Details about the relationship between the length, design and angle for magnet 16, supporting lever 13, aperture 12 and cam rod 14 will not be described here. The whole lever operation can be restored to an equilibrium state by the elastic force of spring 15.

From the above description on the structure of the invention, it is known when no external force is applied, long bar 1 is set on base stand 1 freely. Because there is free motion of the liquid in the long bar 2 and the supporting point is only a sharp line 23, equilibrium cannot be reached easily. If a little bit of force is applied, the liquid will wag mildly to create wave motion which creates much variation for this object. If one pushes either end of the long bar 2, the liquid will move to the lower place to produce a big wave. When the force is released, due to the repulsive force of the magnets and the elastic force of springs 15, the long bar is raised and the other end lowers to repeat the motion. Due to the selection of spring and magnets 16 and 21, the long bar 2 can move violently yet be restored to its horizontal state (because of frictional resistance, it will level down to its original state) within a longer period, so the shaking time can be lengthened. Since the motion of the liquid with regards to the above formation of the mechanism can produce heavy to mild waves, it therefore increases the values for appreciation, entertainment as well as decoration of the invention.

The supporting structure of the long bar and the base stand of the invention provides an unbalanced free state for the long bar. Since there is liquid inside the long bar, theoretically, the long bar will rest at one end. However, due to the operation of the repulsive magnets, the cam rod and the spring forces, the long bar eventually returns to a balance in a horizontal state. It is this feature which produces the appreciation effect for wave motion of the invention. It is also the major objective of the invention.

I claim:

1. A liquid swing decoration comprising:

a partially liquid filled transparent bar;

a base stand;

pivot means positioned between said bar and said base stand and located centrally of said bar;

first and second magnets located on said bar and positioned on opposite sides of said pivot means; and first and second magnets located in said base stand and positioned on opposite sides of said pivot means and in vertical alignment with said magnets on said bar, wherein each magnet on said bar is oriented to exhibit the same polarity as the corresponding facing magnet on said base;

whereby as said bar swings in relation to said base, opposed magnetic action tends to return said bar to a horizontal position.

2. The liquid swing decoration as claimed in claim 1, wherein said base stand includes moving means comprising:

first means for raising said first base stand magnet to a position closer to the corresponding one of said magnets on said bar when said bar is pivoted in the direction of said first base stand magnet; and second means for raising said second base stand magnet to a position closer to the corresponding one of said magnets on said bar when said bar is pivoted in the direction of said second base stand magnet.

3. The liquid swing decoration as claimed in claim 2, wherein said moving means further comprising:

two elongate supporting racks, each rack being pivoted about a pivot means;

two cam rods, one each positioned at a first end of a corresponding supporting rack normal to said supporting rack, and passing through an orifice on the top of said base stand; and two apertures defined in said base stand;

wherein said first and second base stand magnets are affixed to a second end of said two supporting racks and said supporting racks are located inside said base stand, such that when one end of said bar is swung in one direction about said pivot means, the bottom of said bar depresses the adjacent cam downwardly, thereby pivoting its associated supporting rack and moving its associated support base magnet nearer the corresponding aperture so that the support base magnet and corresponding magnet on the bottom of the bar repulse.

4. The liquid swing decoration as claimed in claim 3, including:

spring means comprising a coil spring coaxial with one each of the cam rods; and said coil springs are attached at one end to said supporting rack and at the other end to the inner side of the top of said base stand, thereby providing a force to urge the associated cam rod upwardly when the cam rod is depressed.

* * * * *